US009556564B2

(12) United States Patent
Djerf et al.

(10) Patent No.: US 9,556,564 B2
(45) Date of Patent: Jan. 31, 2017

(54) STRUCTURE FOR RAILROAD TIES HAVING DATA ACQUISITION, PROCESSING AND TRANSMISSION MEANS

(71) Applicant: TJ Technology Holdings, Inc., Canton, OH (US)

(72) Inventors: Torben Djerf, Grand Saline, TX (US); John D. Eisenhut, Canton, OH (US)

(73) Assignee: TJ Technology Holdings, Inc., Canton, OH (US)

( * ) Notice: Subject to any disclaimer, the term of this patent is extended or adjusted under 35 U.S.C. 154(b) by 257 days.

(21) Appl. No.: 14/251,863

(22) Filed: Apr. 14, 2014

(65) Prior Publication Data

US 2015/0292164 A1 Oct. 15, 2015
US 2016/0160449 A9 Jun. 9, 2016

Related U.S. Application Data

(60) Division of application No. 13/309,869, filed on Dec. 2, 2011, now Pat. No. 8,727,228, which is a (Continued)

(51) Int. Cl.
*E01B 3/00* (2006.01)
*B61L 1/02* (2006.01)
(Continued)

(52) U.S. Cl.
CPC . *E01B 3/00* (2013.01); *B61L 1/02* (2013.01); *B61L 27/0077* (2013.01); *B61L 29/22* (2013.01); *E01B 3/10* (2013.01); *E01B 3/46* (2013.01)

(58) Field of Classification Search
CPC ..... E01B 3/00; E01B 3/02; E01B 3/10; E01B 3/12
See application file for complete search history.

(56) References Cited

U.S. PATENT DOCUMENTS 2,538,443 A * 1/1951 Delvaux ..... E01B 3/36 238/117
4,113,177 A * 9/1978 Collins ..... E01B 3/26 238/104

(Continued)

*Primary Examiner* — Jason C Smith
(74) *Attorney, Agent, or Firm* — Renner, Kenner, Greive, Bobak, Taylor & Weber Co., LPA

(57) ABSTRACT

A laminated wood and encapsulated railroad tie structure and its associated method of manufacture. A wood core of laminated wood slats is inserted into an extruded sleeve of scrap tire rubber and polyurethane. A urethane adhesive laminates the wood slats together and serves as a lubricant and bonding agent for placement and secured engagement of the sleeve about the core. End caps are securely engaged at each end of the composite sleeve, being secured to both the wood or other natural fiber core and sleeve. Longitudinal grooves or slots for engagement with a railroad bed characterize the bottom and side surfaces of the sleeve. The core may be provided with bores and grooves to receive sensors and conductors interconnected with a processor and transponder maintained in an end cap. The end case also maintains a photovoltaic device and power source for the active elements of the railroad tie structure. The core may also be manufactured of a wood or other natural fiber giving the core a desired flex modulus to provide for better control and serviceability of associated rails and railway cars.

12 Claims, 5 Drawing Sheets

Related U.S. Application Data continuation-in-part of application No. 12/649,921, filed on Dec. 30, 2009, now abandoned.

(51) Int. Cl.

| | |
|---|---|
| ***B61L 27/00*** | (2006.01) |
| ***B61L 29/22*** | (2006.01) |
| ***E01B 3/46*** | (2006.01) |
| ***E01B 3/10*** | (2006.01) |

(56) References Cited

U.S. PATENT DOCUMENTS

| | | | | |
|---|---|---|---|---|
| 5,609,295 | A * | 3/1997 | Richards | E01B 3/36 238/106 |
| 6,179,215 | B1 * | 1/2001 | Shea | E01B 3/46 238/29 |
| 6,336,265 | B1 * | 1/2002 | Niedermair | E01B 3/46 238/29 |
| 6,659,362 | B1 * | 12/2003 | Hallissy | E01B 3/46 238/35 |
| 8,727,228 | B2 * | 5/2014 | Djerf | B61L 1/02 238/85 |
| 9,080,291 | B2 * | 7/2015 | Jaffe | F16B 5/02 |
| 2008/0035747 | A1 * | 2/2008 | Yuan | B29C 47/0016 238/84 |
| 2008/0173725 | A1 * | 7/2008 | Gibbs | B05D 7/06 238/83 |
| 2008/0179418 | A1 * | 7/2008 | Brough | E01B 3/46 238/85 |
| 2010/0170956 | A1 * | 7/2010 | Cadwell | E01B 3/46 238/85 |
| 2011/0155820 | A1 * | 6/2011 | Djerf | E01B 3/46 238/85 |
| 2013/0008973 | A1 * | 1/2013 | Nosker | E01B 3/00 238/35 |
| 2014/0261047 | A1 * | 9/2014 | Slimak | E01B 3/10 104/2 |

* cited by examiner

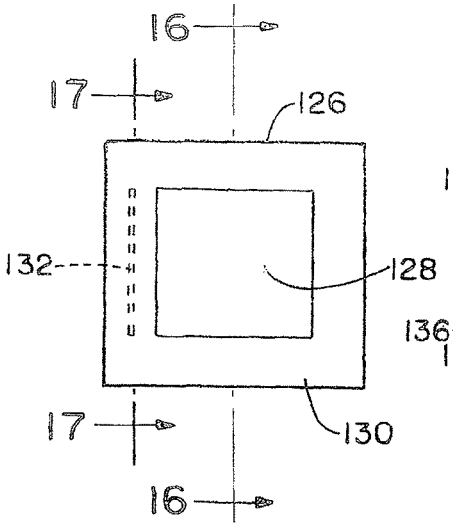
FIG.-15
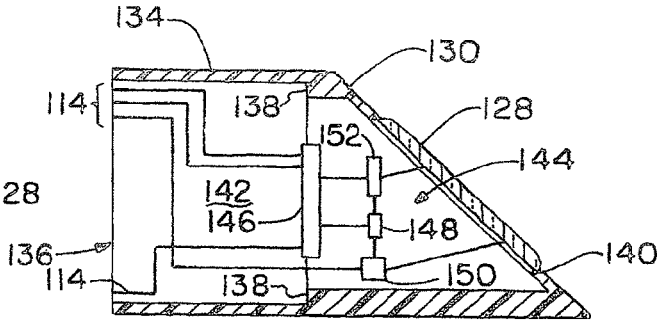
FIG.-16
FIG.-17
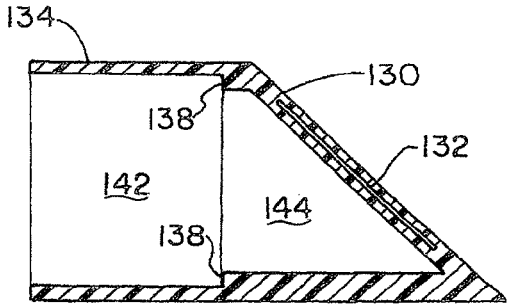
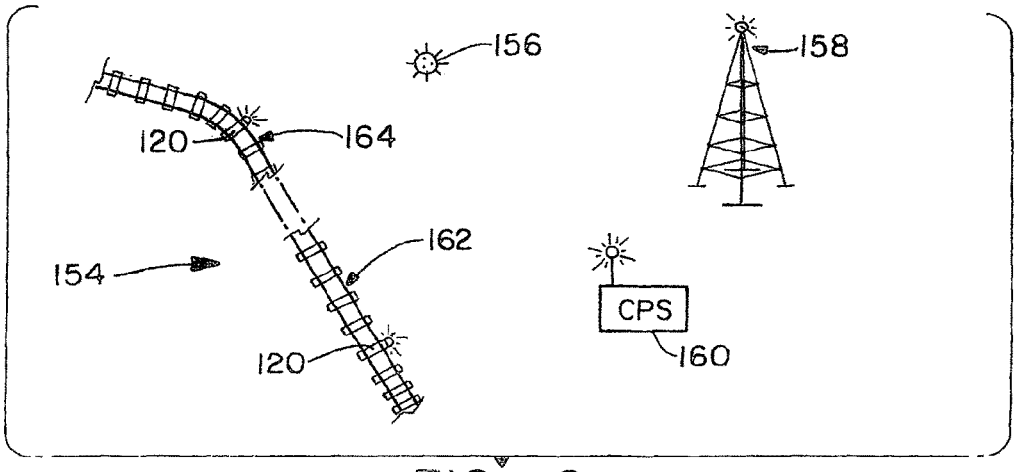
FIG.-18

STRUCTURE FOR RAILROAD TIES HAVING DATA ACQUISITION, PROCESSING AND TRANSMISSION MEANS

CROSS REFERENCE TO RELATED APPLICATION

This application is a divisional of U.S. patent application Ser. No. 13/309,869, filed on Dec. 2, 2011, now U.S. Pat. No. 8,727,228, issued May 20, 2014, which was a continuation-in-part of U.S. patent application Ser. No. 12/649,921, filed on Dec. 30, 2009, now abandoned.

TECHNICAL FIELD

The present invention generally relates to composite structures, and in its preferred embodiments more specifically relates to a load bearing composite structure useful for railroad ties and other load bearing structural members, and particularly to railroad ties that can be manufactured to a particular flex modulus for better interaction with rail cars. Specifically, the disclosed invention also relates to railroad ties having associated data sensors, processors and transponders.

BACKGROUND ART

Railroad ties have traditionally been made of solid wood, typically hardwood that has been chemically treated with a preservative such as creosote to discourage insect attack and biological degradation. Treated solid wood ties, however, have a relatively short useful life span of five to fifteen years before they have deteriorated to the point that they must be replaced, and they often require significant maintenance during that life span. The use of spikes driven into the wood ties to secure the steel rails contributes significantly to the short life of such ties. The oscillating loads imparted to the rail spikes securing the rail gage result in split ties and ejected spikes, both contributing to the need for early replacement or maintenance.

From an environmental perspective the use of solid wood ties is undesirable for several reasons, including the depletion of timber resources that could be put to better uses, and the use of toxic chemicals in the preservative treatment of the ties. Various alternatives to the use of solid wood railroad ties have been devised and are known in the prior art. Reinforced concrete ties are known in the art and are used in at least some rail applications. Concrete ties have a longer life span than wooden ties, but they are substantially more costly than wood. Concrete ties also require different installation techniques, since conventional spikes cannot be driven into concrete.

In another alternative approach, railroad ties are formed of recycled plastics and/or rubber materials using a process that involves heating the material of construction until melted, introducing the molten material into a mold, and allowing it to cool in the mold to produce a solid structure. Like concrete ties, these ties do have a longer life span than wooden ties, and have the environmental advantage of using recycled materials. The ties, and the methods of producing them known in the prior art, are not without disadvantages and drawbacks, however. The most significant problems with the plastic ties themselves include the flex behavior of the crosstie beam and they do not securely retain spikes used to attach rails to the ties nearly as effectively as wooden ties. The flex behavior adversely affects rail performance and displaces ballast requiring more frequent inspection and maintenance. Although spikes can be driven into plastic ties, the low frictional cohesion between metal spikes and plastic ties causes driven spikes to loosen and slip, often immediately or very soon after installation, compromising the stability and integrity of the rails. As a result, plastic ties may require more maintenance than wooden ties to maintain the safety of the rail system. As a more effective alternative to spikes, lag screws or bolts may be used to secure the rails to the ties, but that approach requires costly replacement or modification of existing installation equipment.

The process of making solid ties from recycled plastics is slow and inefficient, because of the lengthy cooling time required and the fact that each tie must remain in the mold through the cooling period. Partly as a result of the inherently inefficient production process, and partly as a result of the large amount of material required for each tie, ties made of recycled plastics have been significantly more costly than wooden ties. Other approaches to making railroad ties are also known in the prior art. In one approach, a slightly smaller wooden tie is formed and coated with a protective material in an effort to retard degradation. In another approach, strips of automotive tire tread are layered and secured together. These and other alternative approaches do not appear to have been successful for a variety of reasons.

There remains a need for a railroad tie structure and a method of making the structure that is cost-effective, reduces the use of solid wood, utilizes recycled materials, resists degradation for an extended period of time, and can be installed using conventional spikes to form a secure and long lasting connection between rails and ties. The present invention provides such a structure and such a method of making railroad ties and other structural members suitable for a variety of uses.

In known railway systems, communication with control stations and the like is often accomplished through the rails themselves, using the rails as a signal conductor. It has been found that such lacks efficiency, reliability and integrity. Moreover, the prior art has been substantially devoid of mechanisms that can be employed with railroad ties by which data pertaining to the railway operation may be acquired, managed, processed and transmitted in order to enhance the efficiency and safety of operation of the railway system.

Prior art railroad ties have typically been of a singular uniform construction, varying from tie to tie within acceptable ranges of deviation, but primarily serving only the role of a support mechanism for the rails themselves. The prior art has failed to recognize the desirability of adapting railroad ties of varying constructions and features to particular uses along the railway track or within the railway system. Specifically, the art has failed to recognize the ability to configure railroad ties with a flex modulus of various natures, such that the flex modulus of railroad ties in one location of a railway system may differ from those in another, enhancing safety in operation and enhancing serviceability of the railway cars and suspension systems.

There remains a need in the art of railway systems for a "smart" railroad tie, having the ability to sense, acquire, manage, process and transmit data relative to the operation of the railway system, and to do so in a viable and cost effective manner. There further remains a need in the art for railway ties that can be structured such as to evidence a flex modulus of a desired nature, the flex modulus of various ties determining their position and utility in the railway system itself.

SUMMARY OF INVENTION

In light of the foregoing, it is a first aspect of the invention to provide a composite structure for railroad ties and the like that are configured to securely retain spikes or other fasteners used to attach the rails to the ties, and to resist aging and degradation for significantly longer periods of time than previously known structures.

Another aspect of the invention is the provision of a composite structure for railroad ties and the like, in which the structural element is maintained and sealed within a protective sleeve.

Yet another aspect of the invention is the provision of a composite structure for railroad ties and the like which is given to ease of manufacture using low cost materials for a core and recycled material for a protective sleeve.

Still a further aspect of the invention is the provision of a composite structure for railroad ties and the like in which the manufacturing method is sufficiently rapid to ensure cost effective throughput in operation.

Yet another aspect of the invention is the provision of a structure for railroad ties having data acquisition, processing and transmission capabilities.

Still a further aspect of the invention is the provision of railroad ties in which sensors of various types may be imbedded in the ties themselves, those sensors acquiring data of various types for receipt and transmission by a data management system maintained by the railroad tie itself.

Still an additional aspect of the invention is the provision of a structure for railroad ties in which the flex modulus of the railroad tie may be predetermined by the composition of the tie, such as solid wood or laminated slats and planks, and the type of wood employed. The foregoing and other aspects of the invention that will become apparent as the detailed description proceeds are achieved by a railroad tie assembly for data acquisition, processing and transmission, comprising: a wood or other natural fiber core; an encasement about said wood or other natural fiber core, said encasement being substantially impervious to degradation from ambient conditions; said encasement comprising a sleeve having an interior with a cross section substantially congruent with a cross section of said wood core, and a pair of end caps, one on each end of said sleeve, at least one said end cap having a receptacle for maintaining therein a processor chip.

Other aspects of the invention that will become apparent herein are achieved by a railway system, comprising: a plurality of railroad ties in spaced apart relationship to each other; a pair of tracks supported by said railroad ties; and wherein each of certain of said railroad ties have at least one sensor, one processor chip, and one transmitter connected thereto for receiving, processing and transmitting data indicative of usage of said railway system.

Still other aspects of the invention that will become apparent are achieved by a railway system, comprising: a plurality of railroad ties in spaced apart relationship to each other; a pair of tracks supported by said railroad ties; and wherein said railroad ties each have a characteristic flex modulus, and a placement of each said railroad tie is a function of said characteristic flex modulus.

BRIEF DESCRIPTION OF THE DRAWINGS

These and other features and advantages of the present invention will become better understood with regard to the following description, appended claims, and accompanying drawings wherein:

FIG. 15 is a front elevational view of the data processing end cap of the invention;

FIG. 16 is a cross sectional view of the data processing end cap of FIG. 15, taken along the line 16-16;

FIG. 17 is a cross sectional view of the data processing end cap of FIG. 15, taken along the line 17-17; and FIG. 18 is an illustrative view of a portion of a railway system employing the concepts of the invention.

BEST MODE FOR CARRYING OUT THE INVENTION

Figure 1:
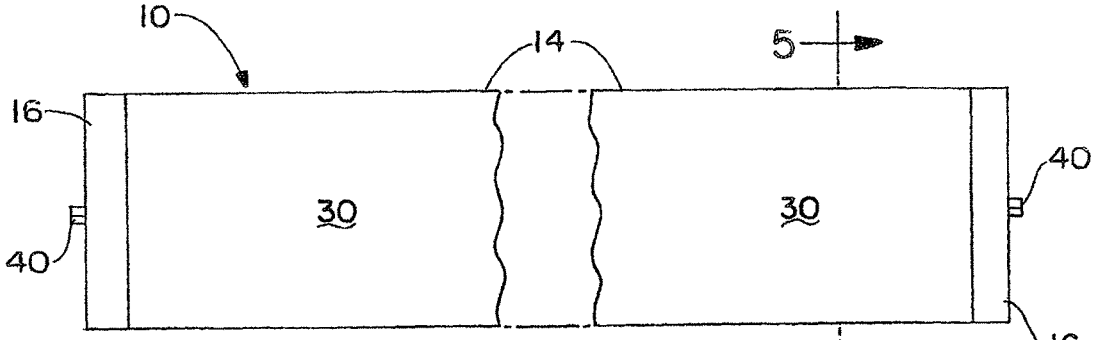
FIG. 1 is a top view of a railroad tie made in accordance with the invention.
Figure 2:
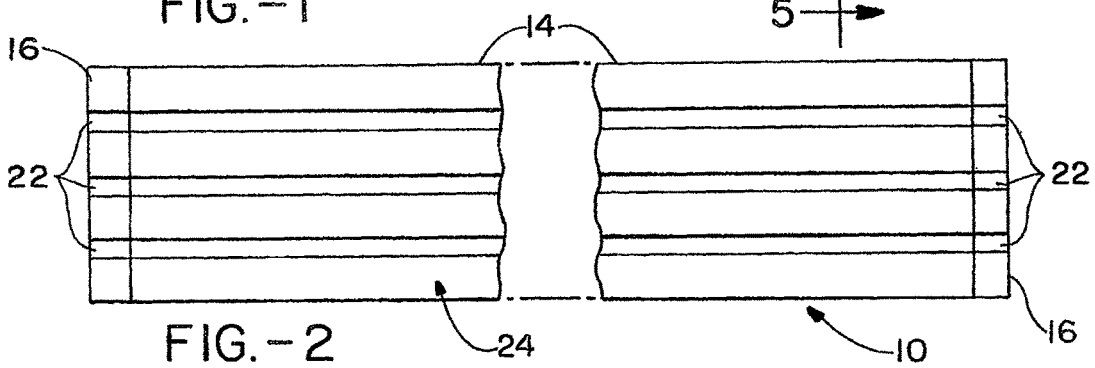
FIG. 2 is a bottom view of the railroad tie of FIG. 1.
Figure 3:
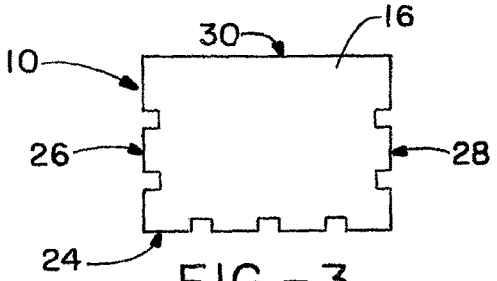
FIG. 3 is a left end elevational view of the railroad tie of FIG. 1.
Figure 4:
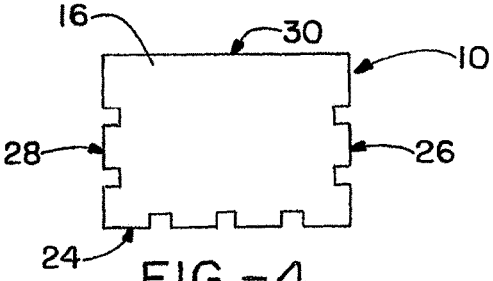
FIG. 4 is a right end elevational view of the railroad tie of FIG. 1.
Figure 5:
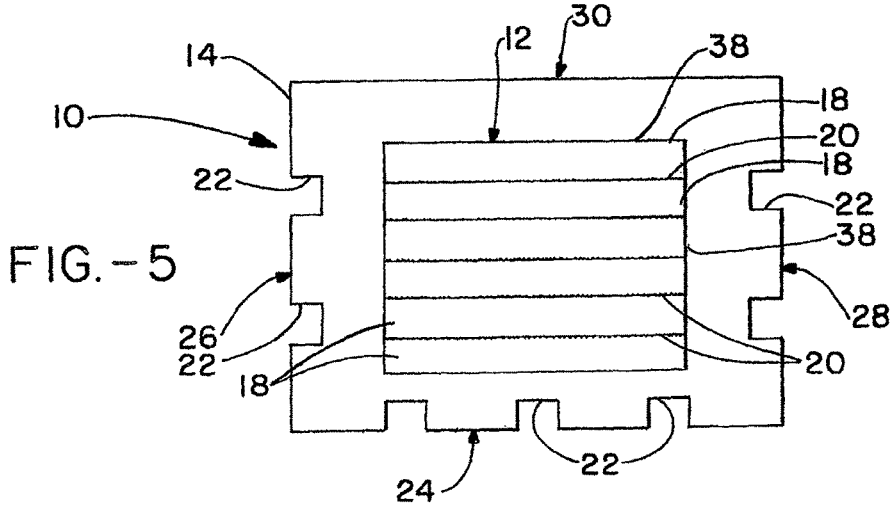
FIG. 5 is an enlarged cross sectional view of the railroad tie of FIG. 1, taken along the line 5-5.
Figure 6:
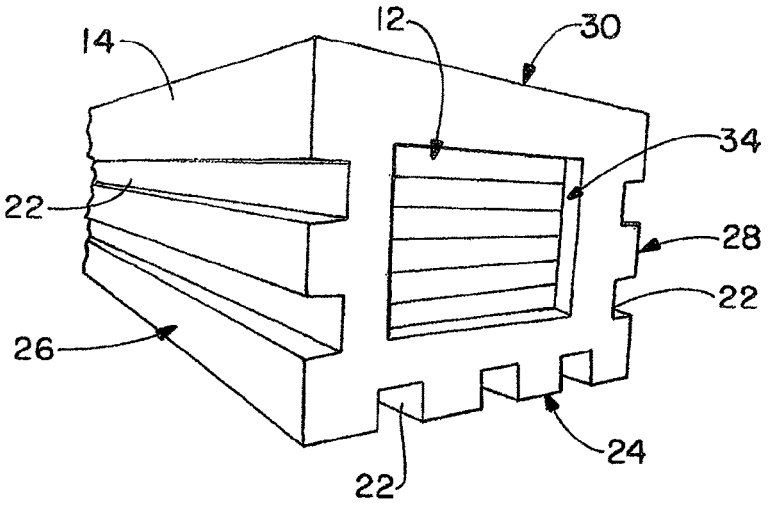
FIG. 6 is a perspective view of an end of the railroad tie during manufacture, before application of an end cap.
Figure 7:
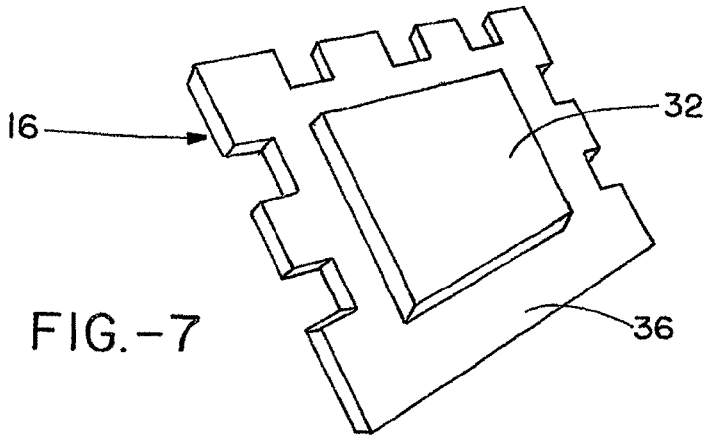
FIG. 7 is a perspective view of an end cap used with the railroad tie assembly.

Referring now to the drawings, it can be seen that in the preferred embodiment the composite structural member of the invention, generally designated by reference number 10, includes a core 12, an outer layer 14, and end caps 16. The structural member of the invention is contemplated to be particularly useful for railroad ties, but the scope of the invention is not limited to use of the structure for that purpose, and encompasses any use to which the structure may prove to be suited.

Core 12 is preferably formed with a generally rectangular cross-sectional configuration, of a plurality of slats, planks or boards 18. Slats 18 are layered or stacked, with each slat in the interior of the stack in face-to-face contact with adjacent slats, and with their side edges and ends aligned. The slats are secured together with a specially formulated adhesive material 20 applied between each slat. In the preferred method of the invention, the selected numbers of slats used to make each core 12 are successively placed in a press with a fast curing adhesive 20 between them. The layered slats are then pressed together in the press for the short time necessary for the adhesive to achieve a sufficient degree of cure to bond the slats 18 together and allow them to be removed from the press. Full curing of the adhesive 20 is completed outside the press, minimizing the hold time in the press and increasing the production rate of the core components of the composite structure. Mechanical fasteners such as screws or the like may be used in addition to the adhesive, if desired, but a sufficiently strong bond can be achieved with adhesive alone to render the use of mechanical fasteners unnecessary. According to a preferred embodiment of the invention, the aforementioned specially formulated adhesive material provides appropriate properties of adhesion, optimal variations of durometer and the capabilities of rapid electron beam curing or other method affording rapid cure.

It is preferred that the width of each slat, from edge to edge, be equal to the width of the completed core. It is also preferred that the length of each slat be equal to the length of the completed core. However, slats of shorter length or width may be used within the scope of the invention, with two or more slats butted together end to end or side by side in each layer of slats forming the completed core. If shorter or narrower slats are used, the butt joints between slats in different layers are preferably staggered to maximize the structural integrity of the core.

After the core 12 is formed, it is preferably impregnated with a plastic material, preferably an acrylic plastic, by placing the core in a bath of uncured plastic resin and subjecting the core and resin to pressure so as to increase the penetration of the resin into the core material. After pressure treatment for a sufficient period of time to achieve the desired degree of penetration, the core is removed from the bath and the resin is allowed to fully cure. Full penetration of the plastic material into the core is not necessary to achieve the benefits of impregnation, which include strengthening the core material and improving its ability to resist splitting when fasteners such as railroad spikes are driven into the core, sealing the core against the entry of moisture for the purpose of resisting decay, and sealing the core against the entry of or attack by wood eating insects such as termites.

Outer layer 14 comprises a hollow, open ended body with a continuous sidewall about and encasing the core 12. If the structural member of the invention is to be used as a railroad tie, longitudinal grooves or slots 22 are preferably formed in lower face 24 and side faces 26 and 28 of the encasing outer layer 14. Such longitudinal grooves or slots facilitate engagement between the structural member and the granular material (gravel) commonly used in railroad construction as a bedding or ballast material. Grooves or slots 22 are preferably omitted from upper face 30 so as to provide a smooth upper face for the placement and connection of rails and gauge plates.

In the preferred embodiment, the cross-sectional configuration of the outer layer matches the cross-sectional configuration of core 12, and the inside cross-sectional dimensions of outer layer 14 are approximately equal to the outside cross-sectional dimensions of core 12. The length of outer layer 14 differs from that of core 12, to accommodate end caps 16 as described below.

Outer layer 14 is preferably formed of materials derived from recycled tires, from which at least the majority of the steel or other metal in the material has been removed. The preferred material of construction includes rubber and non-metallic textile materials from the tires, which have been shredded to particle sizes suitable for handling and for the production process described below. Plastic materials, preferably recycled, may be added to the tire materials, to aid in binding the materials and to modify the characteristics of the tire materials as appropriate to the use for which the structural member is intended.

The outer layer 14 is preferably formed by an extrusion process, in which the recycled tire materials, and additive materials if used, are heated to melt the rubber (and plastic materials if used) and achieve a viscosity suitable for blending and melding the materials and for conveying the melted materials to and through an extrusion die. The heated, blended materials are forced through an extrusion die to form the elongate hollow profile of the outer layer in a continuous flow from the die. The extruded body is immediately cooled to maintain the desired profile, or cross-sectional configuration, and the extruded body is cut at appropriate intervals to produce the outer layers for the composite structural members of the invention.

During the extrusion process, various means for maintaining the cross-sectional profile and dimensions of the extruded body may be employed if needed. As a non-limiting example, the extruded body may be received in a slip form immediately after exiting the extrusion die, to maintain the extruded profile until the body has cooled sufficiently to "set" the configuration. The slip form may be cooled, if desired, to enhance heat transfer and reduce that initial cooling period. As another example, the extruded body may be passed through a vacuum chamber, in which a vacuum is imposed around the hollow body to create a pressure differential between the interior and exterior of the body and prevent the body from deforming before it has cooled sufficiently to maintain its shape.

The extrusion of outer layer 14 as a hollow body substantially reduces the cooling or setting time in comparison to methods of making composite structural members known in the prior art. In prior art methods, structural members are commonly cast as solid bodies in a mold, or a layer of covering material is formed around a core. In both approaches, a lengthy cooling or setting time is required before the bodies can be removed from the mold in which they are formed. Forming the outer layer as an open, hollow body in accordance with the invention eliminates that problem and enables a significantly increased production rate.

According to one embodiment, end caps 16 have dimensions and are configured to be received partially in, and across, the open ends of outer layer 14. Each end cap 16 includes an extension 32, configured and dimensioned to be received in the open ends 34 of the outer layer 14, and a closure cap 36, configured and dimensioned to match the outside configuration and dimensions of the outer layer 14, to be received against the ends of such outer layer. In the preferred embodiment, end caps 16 are formed of the same materials as outer layer 14, and the end caps are preferably formed by molding or casting. Because the volume of material in each end cap is relatively small, the cooling or setting time required before the formed end caps can be removed from molds is acceptably short.

In an alternate embodiment of the invention, the core 12 may extend beyond the outer layer or sleeve 14 and the extension 32 of end cap 16 may be replaced with a recess configured to receive the end of the core 12 extending from the outer layer 14.

After formation of core 12, outer layer 14, and end caps 16, the structural member 10 of the invention is formed by inserting a core 12 into the hollow interior of an outer layer body or sleeve 14, and attaching an end cap 16 to each end of the core and outer layer. In the preferred method, an adhesive material compatible with the core material and the outer layer material is applied to the core, and/or to the interior of the outer layer. Suitable adhesive materials, such as urethane adhesives, have a low coefficient of friction in an uncured state, so that the adhesive material acts as a lubricant to facilitate insertion of the core into the interior of the outer layer, or vice versa, and to prevent deformation of the outer layer during the insertion process. According to a preferred process, a hydraulic ram press may be employed for such purpose. After the core and the outer layer are joined, the adhesive is allowed to cure, as by electron beam or other curing process, forming a strong adhesive bond 38 between the core 12 and the outer layer 14. The end caps 16 may be connected to each end of the composite structure at any appropriate time after the core and the outer layer are joined. Connection of the end caps may be delayed to allow time for the volatile solvents used in the adhesive formulation to evaporate through the open ends of the structure, or, if time need not be allowed for solvent evaporation, the end caps 16 may be connected immediately after the core 12 and outer layer or sleeve 14 are joined. The end caps are preferably secured with an adhesive, such as a urethane adhesive, and mechanical fasteners such as lag screws may be used in addition. It is preferred that an adhesive be used, either alone or in conjunction with mechanical fasteners or lag screws, to seal the joints between the end caps 16 and the rest of the structure. It has been found that a single lag screw 40 through the center of the end cap 16 and into the end of wood core 12 is sufficient to retain the cap while the adhesive cures.

Figure 8:
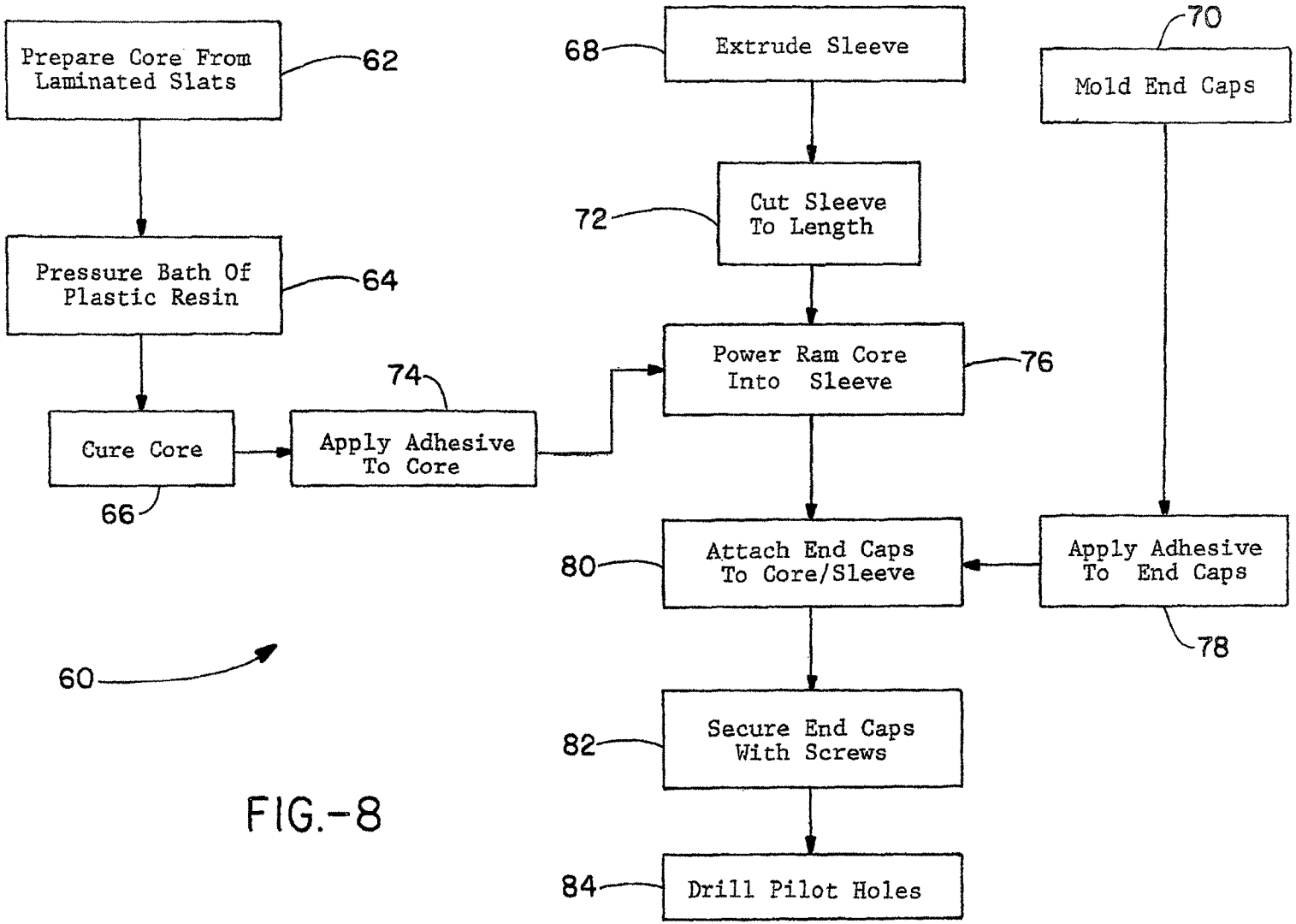
FIG. 8 is a flow chart of the manufacturing process of the invention.
Figure 10:
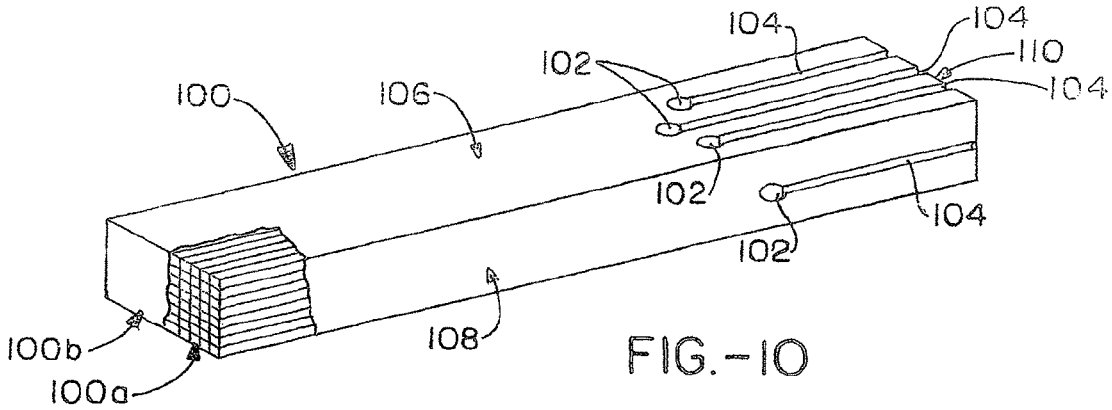
FIG. 10 is an illustrative perspective view of a railroad tie core made in accordance with the invention, showing bores and grooves for sensors and conductors [this is for the top of the core]
Figure 11:
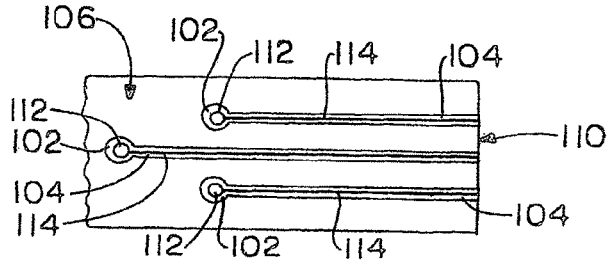
FIG. 11 is a partial sectional view of a top portion of the tie core of FIG. 10, showing the bores and grooves populated with sensors and conductors.
Figure 12:
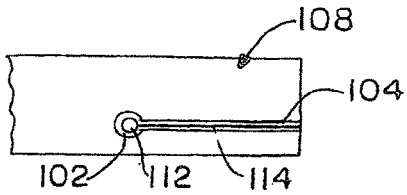
FIG. 12 is a partial sectional view of a side portion of the tire core of FIG. 10, showing the bore and groove populated with a sensor and conductor.
Figure 13:
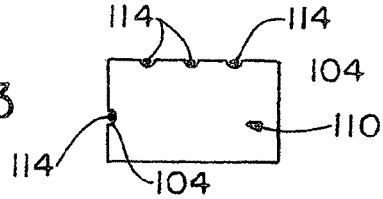
FIG. 13 is an end view of the tie core of FIG. 10, showing the grooves and associated conductors.

With reference now to FIG. 8, it can be seen that the manufacturing process just described is shown in flow chart form and designated generally by the numeral 60. As shown, the core 10 is prepared by adhesively laminating wood slats at 62. In a preferred embodiment of the invention, the laminated core may then be subjected to a pressure bath of plastic resin as at 64, and thereafter the core 66 may be allowed to cure—typically for a matter of minutes. While the cores are being prepared at 62, the sleeve or outer layer is being extruded from a blend of scrap tire rubber and the like at 68, and the end caps are being molded of similar material at 70. As the sleeve is extruded at 68, it is cut to length at 72 and, as presented above, while still warm the process of inserting the wood core into the sleeve is undertaken. In this process, an adhesive is supplied to the core at 74, the adhesive serving as a lubricant for the core as a power ram or other appropriate device is used to drive or draw the core into the sleeve as at 76. At 78, an adhesive is applied to the inner surfaces of the end caps, which are then attached to the combination core/sleeve at 80. If desired, the end caps may be secured by a single lag screw at 82 to ensure retention of the end caps while the adhesive cures. Subsequently, and if desired, either during manufacture or on the job site, pilot holes may be driven through the outer layer or sleeve and into the wood core as at 84 for receipt of an adhesive (if desired) and a retaining screw for a gauge plate, as will be discussed directly below.

Figure 9:
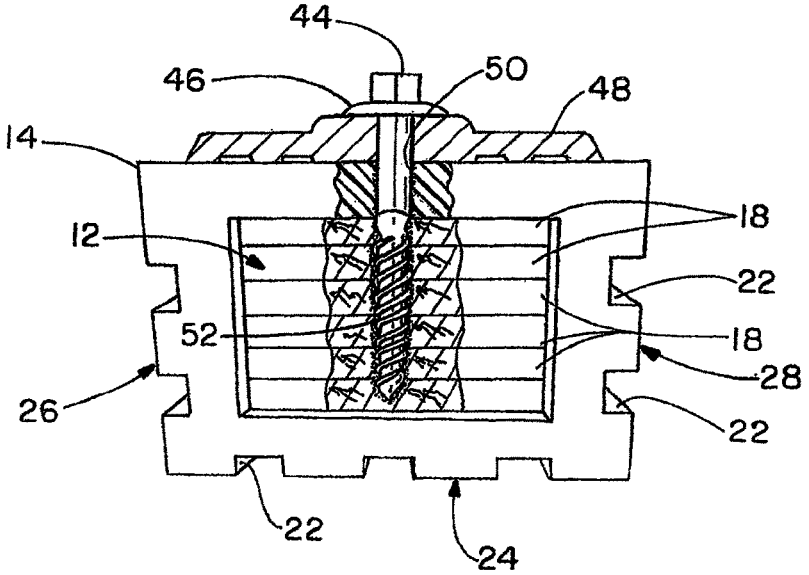
FIG. 9 is a partial cross sectional view of a railroad tie in accordance with the invention, showing the securing of a gauge plate.

The core 12 of the composite structure of the invention is rigid, providing strength and stability to the structure, and the outer layer 14 is resilient, providing cushioning and shock absorbency to the structure. When a railroad spike or other fastener is driven through the outer layer 14 and into the core 12, the core will retain its integrity without splitting, and will securely anchor the spike in the structure, and the resilient outer layer 14 will tend to seal around the spike. As shown in FIG. 9, the spike or retaining screw 44 is driven orthogonal to the planes of facial contact between adjacent planks or slats 18 of the laminated wood core 12 and, in combination with the spike or screw head 44 and washer or retainer 46, secures a gauge plate 48 to the tie 10.

For added integrity of the engagement of the spike or retaining screw 44 with the tie 10, it is contemplated that a pilot hole 50 may be drilled through the outer layer or sleeve 14 and into the wood core 12. Prior to receipt of the spike or retaining screw 44, the pilot hole is filled with an adhesive such as a urethane adhesive 52, enhancing the mechanical bond with the wood core 12 and the sealing engagement with the outer layer 14.

The sealing effect provided by the resilient outer layer not only helps anchor the spike, but also prevents the entry of water and insects into the interior of the structure, substantially curtailing deterioration and extending the useful life of the structural member in comparison to conventional materials. The ability of the resilient outer layer to seal around a penetration, as well as the protection of the core material provided by plastic impregnation, makes the composite structural members of the invention very well suited for use in a marine environment. The structural members of the invention not only resist the ingress of water through penetrations, but also resist deterioration by any water that does find its way into the interior of the structure.

The scope of the invention is not limited to the specific structure and materials of, especially, the core component of the structure described above in reference to the preferred embodiment, and the structure is susceptible to a variety of alternative embodiments and variations. One of the objectives of the invention is to utilize recovered or recycled materials, and especially those that are presently underutilized and are often disposed in landfills. As an alternative to the use of boards, planks or slats to form the core of the structure, the core may be formed of wood chips or scrap that are consolidated, compressed, and impregnated generally as described. It is contemplated that the core may be effectively formed from processed municipal waste materials having high cellulose content, such as wood and paper scraps. Similarly, the outer layer may be formed of alternative materials that will provide the desired characteristics for construction of the composite structure and the intended use. In particular, the wood or other natural fiber core may be wrapped externally with a specially formulated composite fabric layer to add strength and protection as well as produce a specified flex modulus and behavior characteristic desired for various applications. Variations of performance properties, characteristics, materials and uses provided by this invention have been heretofore unattainable in the prior art.

In the foregoing the core is described as extending through essentially the full length of the composite structural member, but the invention encompasses other structures as well. For example, shorter core structures may be used, and a core component disposed at each end of the structure and the space between them either left open or filled with another material. Such a structure is suited for use as a railroad tie, for example, since the rails are laid across and connected to the ties adjacent to each end. Other arrangements of structural core(s), with or without intermediate filler material, may be devised for particular needs and uses.

The railroad ties constructed in accordance with the foregoing are adaptable to various uses, configurations and designs. Attention is now given to particular adaptability of such railroad ties to provide benefits heretofore unattainable in the art. With specific reference to FIGS. 10-13, it can be seen that a railroad tie core 100, typically of solid wood or laminated construction as presented above or described in co-pending patent application Ser. No. 12/649,921, filed Dec. 30, 2009, for "Composite Structure for Railroad Ties and Other Structural Members and Method for Their Manufacture" is provided to eventually be covered with a sleeve and end caps as previously described. As shown, the railroad tie core 100 may consist of a plurality of slats or planks 100*a*, or solid wood 100*b*. In either case, a plurality of partial depth bores 102 are provided in any of various surfaces of the core 100, with grooved slots or the like 104 extending therefrom and preferably to an end of the tie 100, as shown. The bores 102 and grooves 104 may be milled, routed, or otherwise imparted to the core 100. As shown, the bores 102 and grooves 104 may be imparted into the top face 106 or a side face 108 for most applications, although it is not inconceivable that the same might be imparted to a bottom face in certain circumstances. Moreover, while the grooves 104 are shown as extending only to the end 110 of the core 100, the grooves could extend to either or both ends.

The partial depth bores 102 are provided for the purpose of receiving sensors 112 of any of numerous types, with one or more conductors 114 extending from such sensors 112 through the associated grooves 104, serving as conduits to the end 110, as thus shown in FIGS. 10-13. Accordingly, it is most preferred that the bores 102, grooves 104, sensors 112 and conductors 114 not be provided in the top face 106 where they might, without due care, be damaged by spikes, screws, gauge plates and the like.

As will be apparent hereinafter to those skilled in the art, the sensors 112 may comprise pressure sensors, thermal sensors, impulse counters, humidistats, water sensors, impulse or ambient vibration electricity generators, or any of various other types of devices for the purposes of generating data or other outputs conducive to railway management and external services.

Figure 14:
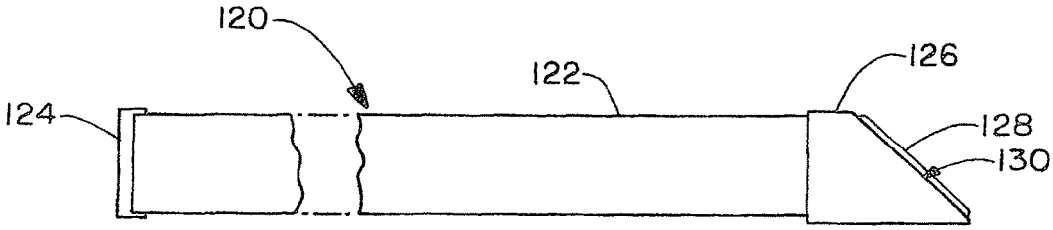
FIG. 14 is a front elevational view of a railroad tie of the invention having an enhanced data processing end cap.

With reference now to FIG. 14, it can be seen that a railroad tie 120 of any of various types, but preferably of the type presented above with regard to FIGS. 10-13, is shown as being encapsulated in a sleeve 122 and having end caps 124, 126 at opposite ends thereof. The cap 124 may be typical of the cap employed in the embodiments presented above with regard to FIGS. 1-9, while the cap 126 is a cap providing for data processing and communication, molded of rubber and/or appropriate polymeric material and adapted to allow the tie 120 to function as a "smart" tie.

The cap 126 is provided with a photovoltaic device 128 attached to an end face 30 thereof, the end face 30 being angled from the horizontal at an angle of 30°-60°, and preferably 45°. In standard fashion, the photovoltaic device 128 is adapted to convert light into an electrical charge or voltage.

An antenna 132, for transmitting and receiving signals, is received within the shell 134 of the cap 126, which defines an opening 136 to receive the end 110 of the tie 100. An abutment shoulder 138 is molded as part and parcel of the shell 134 and serves as a stop for the tie 100 as the end 110 abuts the same. As shown, a pocket 140 is molded into the shell 134 and is particularly sized and adapted to receive the photovoltaic device 128. The shell 134 defines a cavity 142 at the open front end thereof that is adapted to receive the sleeved end 110 of the tie 120 to a point where the end 110 abuts the shoulder 138. The remainder of the enclosure of the shell 134, extending from the shoulder 138 to the closed end thereof, defines a receptacle 144 for receiving and maintaining the operative structure of the tie assembly 120.

As best shown in FIGS. 16 and 17, the receptacle 144 is adapted to receive a microprocessor chip 146 interconnected with at least certain of the conductors 114 of the sensors 112 to receive and process data therefrom. Also maintained within the receptacle 144 is a battery pack 148 providing power to the microchip 146 and any of the appropriate sensors 112 therethrough. The battery pack 148 is interconnected with a charger 150, receiving electrical charge from the photovoltaic device 128 in a first instance and, in another, from an impulse or ambient vibration electricity generator comprising one of the sensors 112 and associated conductor 114. The battery pack 114 also provides charge to a transmitter/receiver 152, interconnected with the antenna 132 and the microprocessor chip 146. The transmitter/receiver may typically have a GPS communications capability associated with it. At least certain of the sensors 112 acquire and provide data of any of various types to the microprocessor chip 146, which is processed in a preprogrammed manner, or as directed by the transmitter/receiver 152 to generate data pertinent to the operation and use of the associated railway system. Impulse counters 112 can serve to count the number of cars passing over the tie, as the rail car wheels generate an impulse each time they pass upon a rail over the tie. In similar fashion, if a sensor 112 comprises a pressure transducer, strain gauge, or the like, the weight of the wheel and its associated load can also be determined and a signal indicative thereof be passed to the microprocessor chip 146 for appropriate use. Of course, the microprocessor chip 146 may also determine the speed of the associated train by the timing of the receipt of signals from the impulse counter 112. With a sensor 112 also being provided as a thermal sensor, the ambient temperature of the railway may be provided to the microprocessor 146, as may be the humidity or any flood conditions in the event that the sensor 112 is a humidistat or water sensor.

It will be appreciated by those skilled in the art that the microprocessor chip 146 may be programmed in any of numerous ways to acquire, process and transmit a multitude of data through the transmitter/receiver 152 regarding the tracks, the ambient, railway cars, train deployment, and overall railway system integrity. With one of the sensors 112 comprising an impulse or ambient vibration electricity generator, and with the provision of the photovoltaic device 128, the charger 150 is enabled to keep the battery pack 148 charged such that the transmitter/receiver 152 can, through the antenna 132, receive and transmit relevant data at all relevant times. Even in the absence of sunlight, the inherent vibrations of railroad ties as trains pass thereover are sufficient to maintain the pack 148 charged.

It will further be appreciated that railroad ties made in accordance with the structure and techniques described above have further capabilities heretofore unknown. A portion of a railway employing ties of the type described herein is shown illustratively in FIG. 18, and designated generally by the numeral 154. As shown, ties 120 of the type described above are placed in spaced relationship along the railway, typically at spacing of as little as several hundred yards to several miles apart. The smart ties 120 communicate with a central processing station 160 through satellites 156 and transmission towers 158, as shown. Accordingly, a central processing station 160 is capable of receiving instantaneous data about rail train operation virtually anywhere. That data can be used to log train operations, resolve safety issues, allow for instantaneous communication with the operating engineers, and the like. This transmission may also be used, in standard fashion, to activate and deactivate railroad crossing signals and gates where the railway crosses vehicle and pedestrian thoroughfares.

The invention also contemplates that the railroad ties 120, having cores 100, may be tailored to achieve particular performance. By selecting appropriate wood and/or laminations of slats and planks, the flex modulus of the railroad ties 100 may be preset or tuned, such that the ties themselves can serve as shock absorbers or the like for the rail car suspension systems, extending their life and utility. Moreover, it has been found that the flex modulus of ties used in a straight section 162 of a railway path may be different from the flex modulus of railroad ties used in curves 164. Accordingly, on the straightaway section of a rail line, railroad ties having a flex modulus providing for a softer or cushiony nature may be employed, while stiffer ties are employed on turns, the stiffness being a function of the turn radius. The nature of the tie composition, whether solid wood, or laminated planks or slats, and the type of wood used for such tie or associated planks or slats all contribute to the flex nature of the tie itself and, accordingly, the response of the rail cars upon the tracks supported by such ties.

The structure, methodology and concepts presented above provide for a durable laminated wood beam railroad crosstie that has heretofore been unachieved. The railroad crosstie consists of scientifically combined elements providing sustained properties essential for optimum transfer of high impact dynamic loads, efficient retention of rail alignment, rail gauge, rail cant, and roadbed integrity. In addition, the cost of production for such crossties is predicated on the reliable and stable supply of low-cost materials. The laminated wood beam eliminates the requirement for the high-cost monolithic beam of hardwood from selective trees. The lamination process facilitates the utilization of the lesser portions of harvested trees, including portions that would otherwise require disposal by burning or congestion of landfills. In addition, reclaimed crossties can be used for forming the slats to be used in the laminated crossties of the invention, with the reclamation process restoring the performance properties of all but severely decayed crossties to full service with better than original quality and high durability.

By forming an encasement sleeve with a thickness of 1-2 inches, and preferably 1.5 inches, a minimal amount of low-cost polyurethane composite materials is required. The sleeve provides an extreme and durable hermetically sealed protective sleeve preserving the high-performance laminated wood beam core that does not adversely impact the natural environment. The sleeve, together with the laminated wood core, does not produce toxic effluence and remains entirely recoverable for future use.

While it has been known that treated timber crossties have a nominal surface life of as little as 2-3 years in a wet climate, the encased laminated wood beam railroad crosstie of the invention is impervious to such adverse effects and should retain optimum functional properties during a service life exceeding 50 years. In addition, during such life, the advanced structure of the invention produces and preserves the optimal performance characteristics of the laminated wood beam that are not otherwise possible. The polyurethane elastomeric compounds amplify and preserve the structural strength and behavior of the optimized wood core. These properties are established and preserved by the elastic properties of the adhesives comprising the laminated wood core. In addition, the hermetic seal of the polymeric encasement protects the laminated wood core from degradation resulting from climatic conditions, insects, microorganisms and decay. In addition, the energy absorbent elastic behavior of the encasement forms a functional structural element of the beam by actively attenuating penetration, impact, vibration, dynamic load, flex and recovery. The polymeric encasement ensures that the original properties of the optimized durable beam are retained throughout its life.

The encased crosstie of the invention has an optimized durometer that enables it to establish elastic conformity with the variegated shape of the gravel base or ballast of the railway bed, without penetrating the protective barrier. An immediate and lasting grip can be formed between the encased railroad tie and the gravel ballast. This is in contrast to current practice that requires trains to cautiously pass slowly over tracks until new crossties have settled into conformity with the gravel ballast. Further, the dynamic loads interacting with the unprotected hard surfaces of crossties produce substantial amounts of pulverized stone that accumulates at the impervious sub base of the railway bed. This accumulation causes the gravel ballast to slide and become displaced. Extensive intervention is required to restore the stability and proper dimensions of the railway bed and ballast. The elastic cushion of the encased crosstie of the invention greatly reduces movement and pulverization of the gravel ballast.

It is contemplated that the impervious polyurethane composite materials used in the applications of the invention will result in a surface life of as much as 125 years in moderate climates, and upward to 65 years in the most challenging of climates. The effects of dynamic load will not produce significant degradation where the hermetic seal and elastic properties have not been compromised by extraordinary external forces.

It has also been found that the superior safety properties of the polyurethane composite railroad tie of the invention include a high melting point, flame resistance and self-extinguishment in that the unit does not support combustion. Moreover, the polyurethane composite emits no toxic effluent and can be recycled.

Essential for safe and efficient railway operation, consistent uniformity reduces the amplitude of high impact dynamic loads, thereby enhancing the character of the ride and extending the durability of the crosstie and all of the elements of the railway structure. Optimization of the performance characteristics of the crosstie, as presented above, ensures greater uniformity. The properties governing the strength and behavior of the common treated timber crosstie vary widely among the different species of trees, as well as for each individual tree. Unlike the treated timber crosstie, the durable laminated wood beam railroad crosstie can be uniformly optimized and will not split, crack or otherwise degrade.

It is elementary that requirements for a given section of rail line vary according to rail alignment and conditions. For example, crosstie performance must accommodate the greater load on the outer rail of a curved track than is required for tangent alignments. Optimal variations in the properties of the durable laminated wood beam railroad crosstie of the invention that are not otherwise possible can be produced on demand. Variations, or tailoring of the crosstie, can include such things as durometer of the elastomeric composites, combinations of various species and types of woods, or other structural components that govern the strength and behavior of the crosstie. Resistance to the adverse effects of exposure to fire, heat, chemical or other external forces can be enhanced as may be needed on demand.

The crossties of the invention have relied upon a laminated wood core because no other crosstie matches the properties of a wood crosstie. The stiffness of prior art concrete crossties fails to sufficiently attenuate the high impact dynamic load incident to railways. The greater weight and hard surfaces of concrete crossties displaces and pulverizes the gravel ballast of the rail bed. Often selected for use in cold and wet climates the service life of concrete ties are often cut short when water penetrates the fissures in the concrete and expands upon freezing. Each repetition increases the fissure until failure. Having the preferred performance characteristics of a wood crosstie and the impervious outer casing the composite crosstie will last longer and perform better than the concrete crosstie that was specifically developed for extending the service life of railroad crossties in wet and cold climates. The flexural behavior of the scrap plastic crosstie pumps the gravel ballast away from the roadbed. In contrast, the wood crosstie of the invention is lightweight and flexes with optimal sufficiency to attenuate, dampen and consistently recover in response to the high impact dynamic load. The durable laminated wood beam crosstie uniformly optimizes and preserves this strength and behavior—which is otherwise not possible to achieve.

Essential to retain rail alignment, rail cant and rail rotation (rollover), the rail plate and fasteners must remain fixed and secure with an optimum degree of resiliency to attenuate the high impact dynamic loads incident to railway operation. For example, the concrete crosstie of the prior art relies on a small elastic pad and spring-loaded fastener to attenuate the damaging impact. These pads and springs quickly fail by compression and abrasion to impose an abrasive impact directly on the concrete tie by the steel rail plate. This in turn erodes the surface and fractures the concrete. This ultimately leads to rail gauge spread. Frequent inspection, repair and replacement are required to prevent sudden failure and derailment. In contrast, the polyurethane encasement of the durable laminated wood beam crosstie of the invention forms an impervious extensive layer of shock absorbent elastic padding for the rail plate. The optimal degree of elasticity enables all components to absorb the impact, extend and recover, thereby defeating creep and attenuating the dynamic load.

The durable laminated wood beam crosstie of the invention also securely accommodates both cut spike and screw spike fasteners. Rail fasteners are held in place by the self-healing elastomeric composite sleeve, the cut spike will hold more firmly than one driven into a treated timber crosstie. Without requiring much additional effort, the screw spike can be installed with a greater assurance of permanence. As presented above, this procedure includes a drilled hole filled with special liquid polyurethane composite that lubricates the insertion and permanently affixes the screw spike and seals the hole. The driven cut spike and screw spike can be removed and replaced. More liquid polyurethane composites can be used to seal the void and hold either spike.

The polyurethane composite encasement sleeve of the invention forms an impervious extensive elastic binder that regulates the uniform transmission, attenuation and recovery from high-impact dynamic loads and preserves the original properties of the laminated wood beam railroad crosstie. In addition, the polyurethane composite encasement sleeve forms a safe and secure enclosure for various useful devices, providing data acquisition, processing and transmission functions useful for both intrinsic as well as extrinsic applications. The data acquisition processing and transmission component of the durable laminated wood beam crosstie provides a durable and efficient means to facilitate communication of necessary data throughout a railway system.

Thus it can be seen that the various aspects of the invention have been attained by the structures and methodologies presented above. While in accordance with the patent statutes only the best mode and preferred embodiments of the invention have been presented and described in detail, the invention is not limited thereto or thereby. Accordingly, for an appreciation of the true scope and breadth of the invention reference should be made to the following claims.

What is claimed is:

1. A railway system, comprising:

a plurality of railroad ties placed in spaced apart relationship to each other;

a pair of tracks supported by said railroad ties; and wherein each of said railroad ties has a characteristic flex modulus tailored by a selection taken from the group of an appropriate wood and laminations of slats and planks forming said ties, and wherein said placement of each said railroad tie is a function of said characteristic flex modulus, those having a flex modulus of a cushiony nature being placed in straightaway sections of rail line as compared to stiffer ties being placed in turns, the stiffness of the ties being a function of a turn radius.

2. The railway system according to claim 1, wherein said ties comprise a wooden core sealed and encased by a polymeric sleeve.

3. The railway system according to claim 2, wherein said polymeric sleeve has a durometer accommodating elastic conformity with a gravel base of a railway bed.

4. The railway system according to claim 3, wherein said elastic conformity maintains the stability and integrity of said gravel base.

5. The railway system according to claim 2, wherein said wooden core comprises a plurality of laminated wooden slats selected to effect a desired flex modulus.

6. The railway system according to claim 5, wherein said wooden slats are of various types of wood selected to effect a desired flex modulus.

7. The railway system according to claim 2, wherein said polymeric sleeve forms an hermetic seal about said wooden core.

8. The railway system according to claim 7, wherein said polymeric sleeve is formed of a polyurethane composite material.

9. The railway system according to claim 2, wherein said polymeric sleeve is characterized by longitudinal slots engaging and receiving a gravel base of a railway bed.

10. The railway system according to claim 9, wherein said grooved polymeric sleeve is resilient, providing cushioning and shock absorbency for loads imparted to said railroad ties.

11. The railway system according to claim 9, wherein said polymeric sleeve has a resilience that seals about spikes and retaining screws driven through said sleeve and in to said wooden core.

12. The railway system according to claim 2, wherein said wooden core is formed from laminated wooden slats subjected to a pressure bath of plastic resin.

* * * * *